US008393271B2

(12) United States Patent
Feilecker

(10) Patent No.: US 8,393,271 B2
(45) Date of Patent: Mar. 12, 2013

(54) POCKET STAMP

(75) Inventor: Alois Feilecker, Gunskirchen (AT)

(73) Assignee: Colop Stempelerzeugung Skopek Gesellschaft m.b.H. & Co. KG., Wels (AT)

( * ) Notice: Subject to any disclaimer, the term of this patent is extended or adjusted under 35 U.S.C. 154(b) by 395 days.

(21) Appl. No.: 12/733,858

(22) PCT Filed: Sep. 16, 2008

(86) PCT No.: PCT/AT2008/000332

§ 371 (c)(1),
(2), (4) Date: Mar. 24, 2010

(87) PCT Pub. No.: WO2009/039539

PCT Pub. Date: Apr. 2, 2009

(65) Prior Publication Data

US 2010/0294151 A1 Nov. 25, 2010

(30) Foreign Application Priority Data

Sep. 26, 2007 (AT) ..... A 1518/2007
Jan. 22, 2008 (AT) ..... A 88/2008

(51) Int. Cl.
*B41K 1/42* (2006.01)

(52) U.S. Cl. ..... 101/333; 101/103; 206/755

(58) Field of Classification Search ..... 101/101, 101/103, 109, 327, 333, 368, 405; 206/747, 206/748, 751, 755, 759
See application file for complete search history.

(56) References Cited

U.S. PATENT DOCUMENTS

| | | | | |
|---|---|---|---|---|
| 193,187 | A * | 7/1877 | Scott | 101/333 |
| 3,166,365 | A * | 1/1965 | Zeamer et al. | 312/208.4 |
| 5,105,738 | A | 4/1992 | Mehaffey | |
| 5,505,132 | A | 4/1996 | Warren et al. | |
| 6,199,482 | B1 * | 3/2001 | Yasoshima | 101/333 |
| 6,290,419 | B1 | 9/2001 | Hirschmann | |

(Continued)

FOREIGN PATENT DOCUMENTS

| | | |
|---|---|---|
| FR | 2 514 699 | 4/1983 |
| GB | 544 055 | 3/1942 |
| GB | 544005 | 3/1942 |
| WO | WO 2006/120546 | 11/2006 |

OTHER PUBLICATIONS

English translation of International Preliminary Report on Patentability.

(Continued)

*Primary Examiner* — Ren Yan
(74) *Attorney, Agent, or Firm* — Collard & Roe, P.C.

(57) ABSTRACT

The invention relates to a pocket stamp (1) comprising a housing (2) which is configured in the shape of a case (3) having two articulately connected shell-shaped housing parts (4, 5) which can be displayed from a closed position, in which they are detachably connected to one another, into an open position, in which a die plate (24) accommodated in one of the housing parts (4) and protruding over the edge thereof is present in the operating or impression position thereof, in which the other housing part (5) is offset toward the rear in relation to the die plate (24), wherein in one housing part (5) at least one detent element (10) in the form of a hook (18) is provided and in the other housing part (4) a detent element (16) in the form of a ledger (20) cooperating with the hook (18) is provided, one of the detent elements (16) being resiliently movable.

25 Claims, 20 Drawing Sheets

U.S. PATENT DOCUMENTS

| | | | | |
|---|---|---|---|---|
| 6,708,613 | B2 | 3/2004 | Faber | |
| 6,829,989 | B2 * | 12/2004 | Chudy | 101/35 |
| 6,877,425 | B2 * | 4/2005 | Lynton | 101/333 |
| 7,216,586 | B1 | 5/2007 | Yu | |
| 7,246,556 | B1 * | 7/2007 | Stoneberg et al. | 101/333 |
| 7,810,644 | B2 * | 10/2010 | Fraillon | 206/581 |
| 2003/0089258 | A1 | 5/2003 | Rigoni | |

OTHER PUBLICATIONS

International Search Report.

* cited by examiner

POCKET STAMP

CROSS REFERENCE TO RELATED APPLICATIONS

This application is the National Stage of PCT/AT2008/000332 filed on Sep. 16, 2008, which claims priority under 35 U.S.C. §119 of Austrian Application No. A 1518/2007 filed on Sep. 26, 2007 and Austrian Application No. A 88/2008 filed on Jan. 22, 2008. The international application under PCT article 21(2) was not published in English.

The invention relates to a pocket stamp including a housing which is configured in the shape of a case having two articulately connected shell-shaped housing parts which can be brought from a closed position, in which they are releasably connected to each other, into an open position, in which a stamp plate accommodated in one of the housing parts and protruding over the edge thereof is present in its operation or impression position, in which the other housing part is offset toward the rear in relation to the stamp plate.

From U.S. Pat. No. 6,290,419 B1, a pocket stamp is known, in which a holder to be extracted from a housing in sleeve shape is provided, to which a stamp plate is hinged so as to enable stamp impressions to be made in the state of the holder extracted from the sleeve together with the stamp plate. A basically similar pocket stamp is disclosed in U.S. Pat. No. 6,708,613 B2, wherein a stamp plate and an ink pad are pivotably mounted to a common holder; in the folded state of the stamp plate and the ink pad, these can be inserted into a sleeve provided as a housing, along with a part of the holder. Although those known pocket stamps have proved successful in practice, care has to be taken that the pivotal movement between the stamp plate and the holder will, on the one hand, enable the abutment of the stamp plate on the holder in the stamping position to facilitate its use during stamping and, on the other hand, also be designed in a stable manner. Furthermore, the construction is relatively demanding in view of the various moving parts.

On the other hand, WO 2006/120546 A2 discloses a stamp which is comprised of two housing parts articulately connected to each other by a film hinge. One of the housing parts contains a sunk ink pad. The other housing part contains an impression plate with projecting graphic symbols, which are in direct contact with the ink pad of the first housing part in the closed state of the stamp. In the impression position, the two housing parts are disposed at a relative angle of 180°. In the closed position, a fixation can, for instance, be obtained by a pin engaging into a depression. On the other hand, also a sleeve for holding the housing parts together may be provided. Those means for holding the housing parts together are, thus, comparatively unreliable and difficult to open, or even inconvenient.

FR 2 514 699 A discloses a similar hand stamp, in the shape of a key tag, with a box and a lid, which are connected to each other via a hinge joint. The box accommodates an ink pad over its entire surface. An impression plate with protruding embosses is non-detachably connected to the lid. The lid and the box are held in the closed position by a simple, unreliable bow snap closure.

U.S. Pat. No. 5,105,738 A describes a hand stamp with an articulation piece to displace the hand stamp between an open and a closed position. An impression plate is pivotally mounted in a housing within two movable wall portions. The application of a force on parts or surfaces will cause a torque, thus moving the hand stamp into the open position with the impression plate, along a guide, being brought into the impression position parallel with a surface to be imprinted. In the impression position, the two movable wall portions are disposed at a relative angle smaller than 90°.

GB 544,005 A shows a stamp which can be attached to the sealing cap of a fountain pen by the aid of a clip. The stamp is comprised of two parts, namely a container whose upper part is configured as a hinge joint, and a lid including a stamp plate. On top of the lid, an elastically bent part with a tongue is attached for fixation in the impression position. A clip on the end of the stamp plate serves to fix the stamp plate in the folded state.

It is now an object of the invention to provide a pocket stamp of the initially defined type, which is not only simple and inexpensive in terms of production and mounting and, in addition, sturdy and reliable in operation during the making of a stamp impression, but, in particular, also comprises a safe yet easily openable closing mechanism which is favorable both in terms of production engineering and in terms of a long service life and reliable operation. Furthermore, the pocket stamp is to be suitable for various sizes as a function of the respective goal with basically the same structure, while enabling the production of as few parts as possible, preferably by injection-molding of synthetic materials.

To solve this object, the invention provides a pocket stamp of the initially defined kind, which is characterized in that at least one detent element in the shape of a hook is arranged in one of the housing parts and a detent element in the shape of a ledger, which cooperates with the hook, is arranged in the other housing part, wherein one of the detent elements is resiliently movable.

In the present pocket stamp with the case-like housing having two housing halves or parts articulately connected to each other in a hinge-like manner, the housing parts may be designed in a substantially shell-shaped, though not necessarily identical fashion, wherein they are, moreover, preferably produced in one piece, particularly of synthetic materials, for instance by injection molding, although they may also each be multipart, for instance, for the purpose of facilitating the mounting of the stamp plate, but, e.g., also of the detent elements. One of the housing parts contains the stamp plate, which, in the open position, protrudes over the edge of this shell-shaped housing part in order to enable the making of a stamp impression. The other housing part in this opened position is pivoted away from the stamp plate, or the closed position, by at least about 180°, and preferably has a smaller structural height so as to be offset toward the rear in relation to the plane of the stamp plate as well as in relation to the plane of the edge of the housing part containing the stamp plate in the impression position, in order not to impede the making of an impression on a substrate.

The housing parts can be resiliently biassed into the open position, wherein, in particular, a hinge joint connecting the housing parts is provided, which is biassed by a spring, e.g. a helical torsion spring. The housing part in which the stamp plate is arranged in a protruding manner at least during the making of an impression functions as a "handle", and the other housing part may be regarded as a "swing lid" to be pivoted away from the "handle housing part", preferably by the action of the spring bias, when an impression is to be made.

The two housing parts can be safely latched or closed by the hook engaging the ledger from behind, and none the less easily and reliably transferred into a release position by actuating one of these detent elements so as to open the housing. The hook is preferably immovably arranged on its housing part and, in particular, designed in one piece with said housing part; by contrast, the ledger may be accommodated in its housing part in a resiliently movable manner. In this respect, the movable ledger can be accommodated in the housing part that can be dimensioned to be slightly larger than the other housing part in view of its function as a handle; the ledger may in this case be provided in the housing part below (behind) the stamp plate.

For the simple and reliable actuation and locking, it will furthermore be suitable, if two hooks and two ledgers are provided, preferably symmetrically in relation to a housing center plane extending perpendicularly to the hinge axis. Such a configuration will ensure bilateral interlocking or latching, which will lead to a safely closed position of the two housing parts reliably avoiding inadvertent opening, on the one hand, and also enables the reliable operation from two sides of the housing part, for instance by a pressure respectively exerted on two housing sides by the thumb on the one side and the index finger on the other side, in order to open the housing, on the other hand. Resiliently movable push buttons may be mounted in the respective housing part for such opening, e.g. by displacing the ledgers out of the engagement position with the hook and, in general, the resiliently movable detent element out of engagement with the fixed detent element. A particularly simple configuration will, however, be obtained, if the housing part in which the resiliently movable detent element is arranged comprises a press piece, which cooperates with an actuation region of the detent element. In this respect, it will, furthermore, be advantageous for a particularly simple configuration, if the press piece is formed by an elastically deformable wall portion of the housing part. In order to prevent the detent elements from inadvertently disengaging when the pocket stamp is put into a pocket, it is suitable to avoid projecting parts of the pressure or deformation wall portions, and it will accordingly be of advantage if the elastically deformable wall portion is provided within the housing contour.

In practice, it has also proved to be beneficial if the resiliently movable detent element is formed by an insert body detachably inserted in the housing part. This insert body will facilitate the production of the individual components of the pocket stamp and its mounting, wherein it will, for instance, be advantageous if said insert body is accommodated in the stamp-plate-receiving housing part below or within said stamp plate.

In order to achieve as uniform an impression as possible when making a stamp impression, even if the stamp-plate-carrying housing part is comparatively small, it will be favorable if the stamp plate is resiliently mounted in its housing part. And even if the housing part is not held centrally during stamping, the resilient mounting of the stamp plate will provide a compensation for such eccentric holding so as to achieve a uniform impression. Moreover, such resilient mounting of the stamp plate will likewise be beneficial in those cases where the stamp plate is inked by an ink pad—which will consequently have to be accommodated in the other stamp part—in the closed position, since a precisely parallel positioning of the stamp plate and the ink pad will not always be ensured 100 percent in the closed position of the pocket stamp on account of the pivotability of the two housing parts relative to each other; the resilient mounting will likewise provide compensation here so as to ensure uniform inking of the stamp plate.

If an insert body with the locking ledger(s) is provided, it will furthermore be beneficial for the resilient mounting of the stamp plate, if the insert body comprises a central spring arm which, with the stamp plate inserted in the housing part, presses the same against edge-side stops provided in the housing part. For a simple production and mounting, it is, moreover, favorable if the stops are formed by hook projections which are firmly connected, or designed in one piece, with the housing part and, in the operating position, are engaged from behind by snap-in hooks provided on the stamp plate. For the symmetrical configuration and operation already discussed above, it will furthermore also be beneficial if the insert body includes two lateral ledgers, which extend from a common base portion provided adjacent the joint on one side of the housing to the other side of the housing. In this respect, it will be advantageous for a resilient mounting of the stamp plate in a manner as centric as possible, if the spring arm likewise extends away from the base portion of the insert body, yet is shorter than the ledgers and carries an abutment cam for the stamp plate.

As already mentioned, an ink pad may be arranged in the other of the two housing parts, which ink pad will abut on the stamp plates in one of the housing parts in the closed position, thus inking the same. The present pocket stamp is, however, suitable for the most diverse stamp plate configurations, which belong to the prior art as such. The stamp plate may, for instance, comprise reception depressions, e.g. in the shape of grooves, for insertable stamp types. The stamp plate may also be a pre-inked stamp plate, having a partially porous impression surface behind which an ink storage area is provided in the porous stamp plate. The impression surface may, for instance, be of the flash type, according to which the types are obtained in that the surface remains porous in the area of the types, whereas it will be closed by a light "flash" of suitable intensity in the remaining region.

In order to enable the fixation of the pocket stamp, if necessary, one of the housing parts may comprise a lug for attaching a strap or chain; it is also possible that one of the housing parts instead, or additionally, carries a clip or a spring clamp for clamping the pocket stamp to a pocket or the like. For a simple fixation of the clip to the housing part, it will be advantageous if one of the housing parts has a reception opening for receiving at least one fastening web of the clip. In this respect, it is favorable if the fastening web comprises a catch nose so as to enable the clip to be readily fastened to and, if required, again removed from, the housing part by a snap-in or catch connection. Such a snap-in or catch connection will also enable different clips to be selectively fastened to the housing part.

In order to provide a reliable snap-in or catch connection, it will be advantageous, if the reception opening tapers from its opposite ends to a substantially central snap-on edge. The catch nose will thereby be pivoted into the tapering reception opening during insertion and, after having passed the reception opening region having the smallest cross section, can rebound again so as to reliably ensure a catch or snap-in connection.

A reliable catch or snap-in connection will be ensured, if the catch nose of the fastening web, in the position received in the reception opening, engages from behind an edge of an annular reception recess of an oppositely located fastening web. Alternatively, it is also possible that the catch nose of the fastening web, in the position received in the reception opening, engages from behind a catch nose of an oppositely located fastening web. A catch or snap connection may also be obtained in a simple manner, if the clip comprises just a single bow-shaped fastening web, with the catch nose of the fastening web, in the position received in the reception opening, engaging from behind the snap-on edge of the reception opening.

Furthermore, one of the housing parts may also comprise an observation window to receive an impression sample or, briefly, a printing pattern. In a preferred manner, at least one of the housing parts is, moreover, formed in one piece of a synthetic material, in particular by injection or injection molding. Preferably, both of the housing parts are produced in this way. In a preferred embodiment, the pocket stamp will accordingly consist of two monolithic housing parts, an insert body, and a spring for biassing the hinge joint, besides the stamp plate and, optionally, the ink pad.

In the following, the invention will be explained in more detail by way of preferred exemplary embodiments illustrated in the drawing, to which it is, however, not to be restricted. In detail, in the drawing, FIGS. 1, 2 and 3 are illustrations of an embodiment of the pocket stamp according to the invention in a schematic oblique view from front and top, in a side view and in an oblique view from front and below, respectively;

Figure 6:
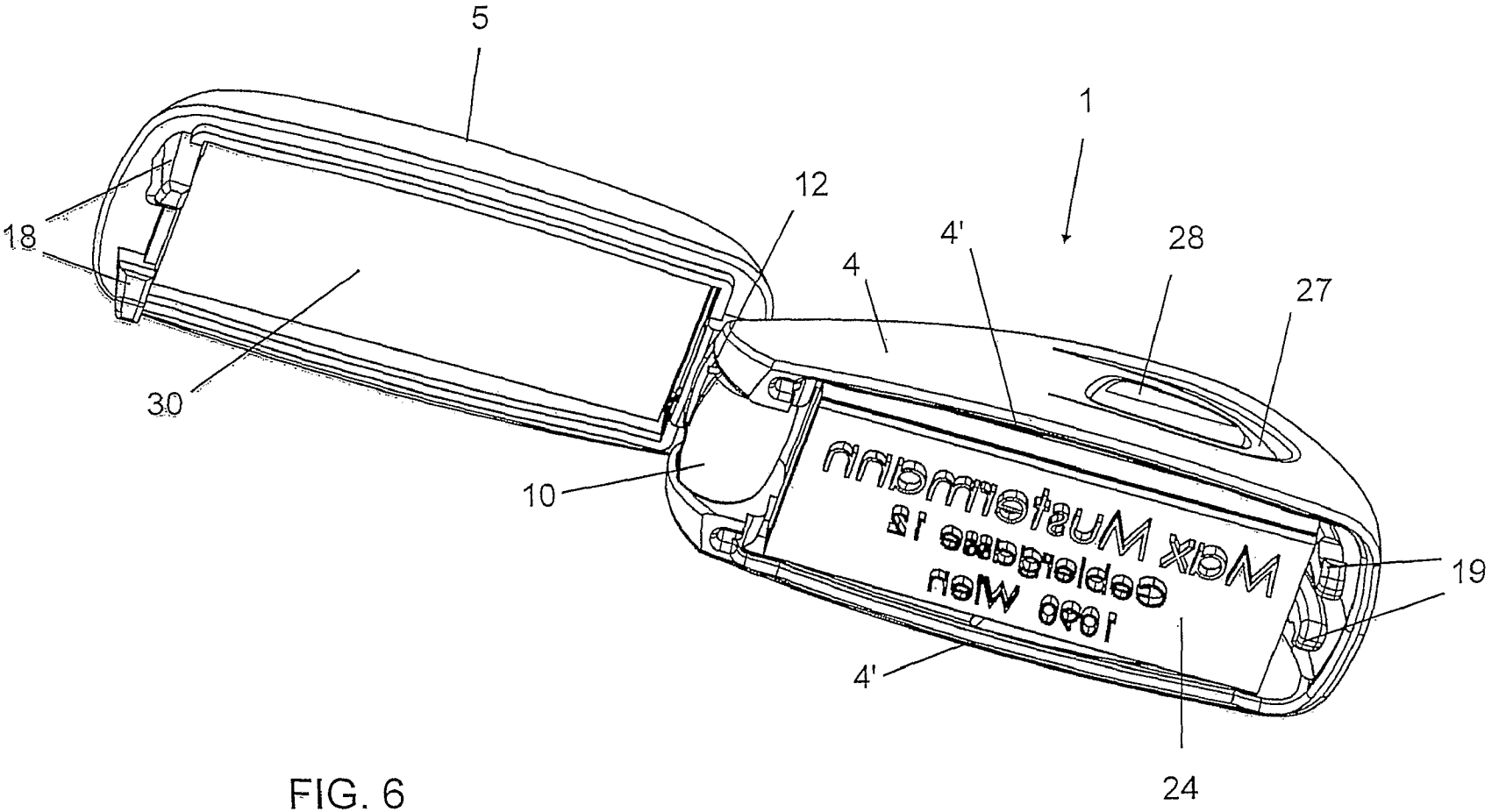
FIG. 6 shows the pocket stamp according to FIGS. 1 to 5 in the open position, ready for making an impression.
Figure 7:
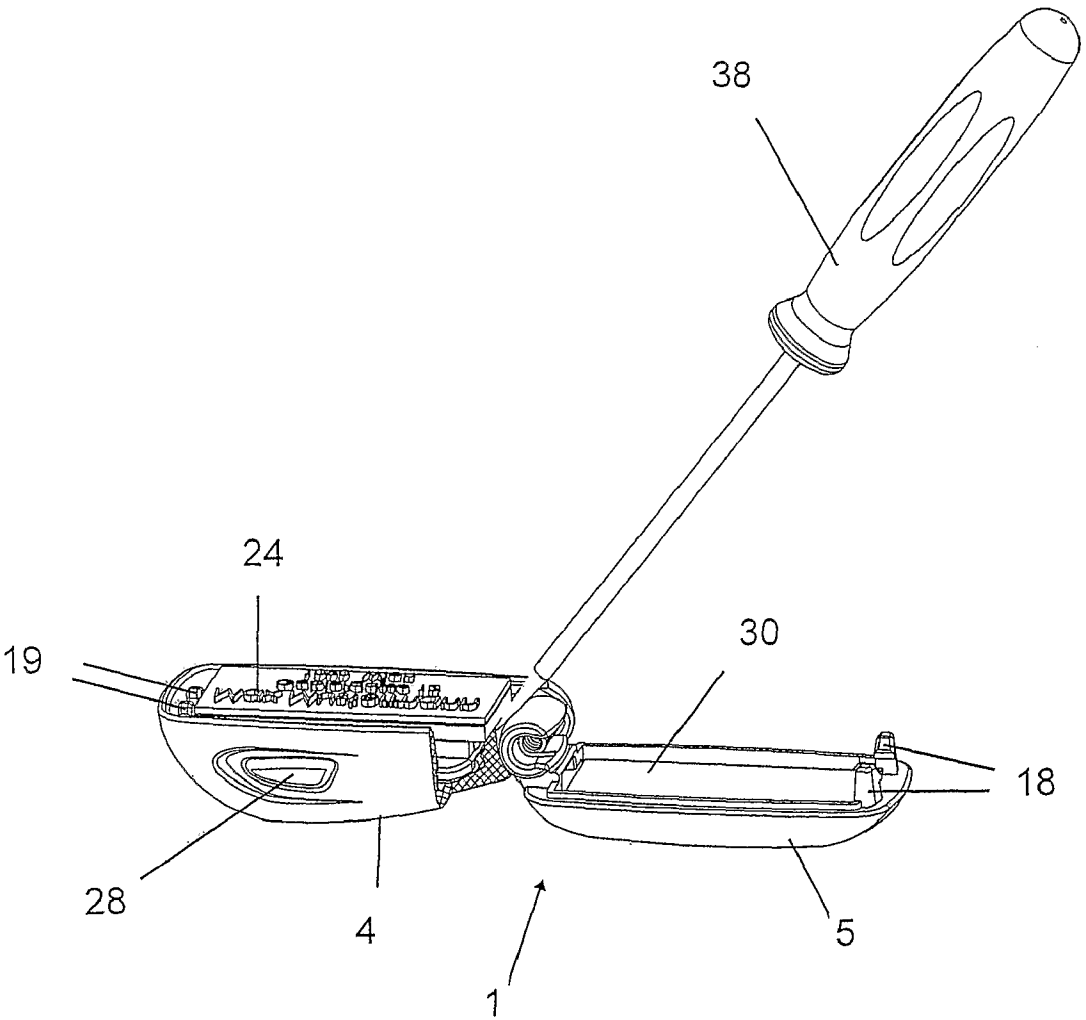
Figure 8:
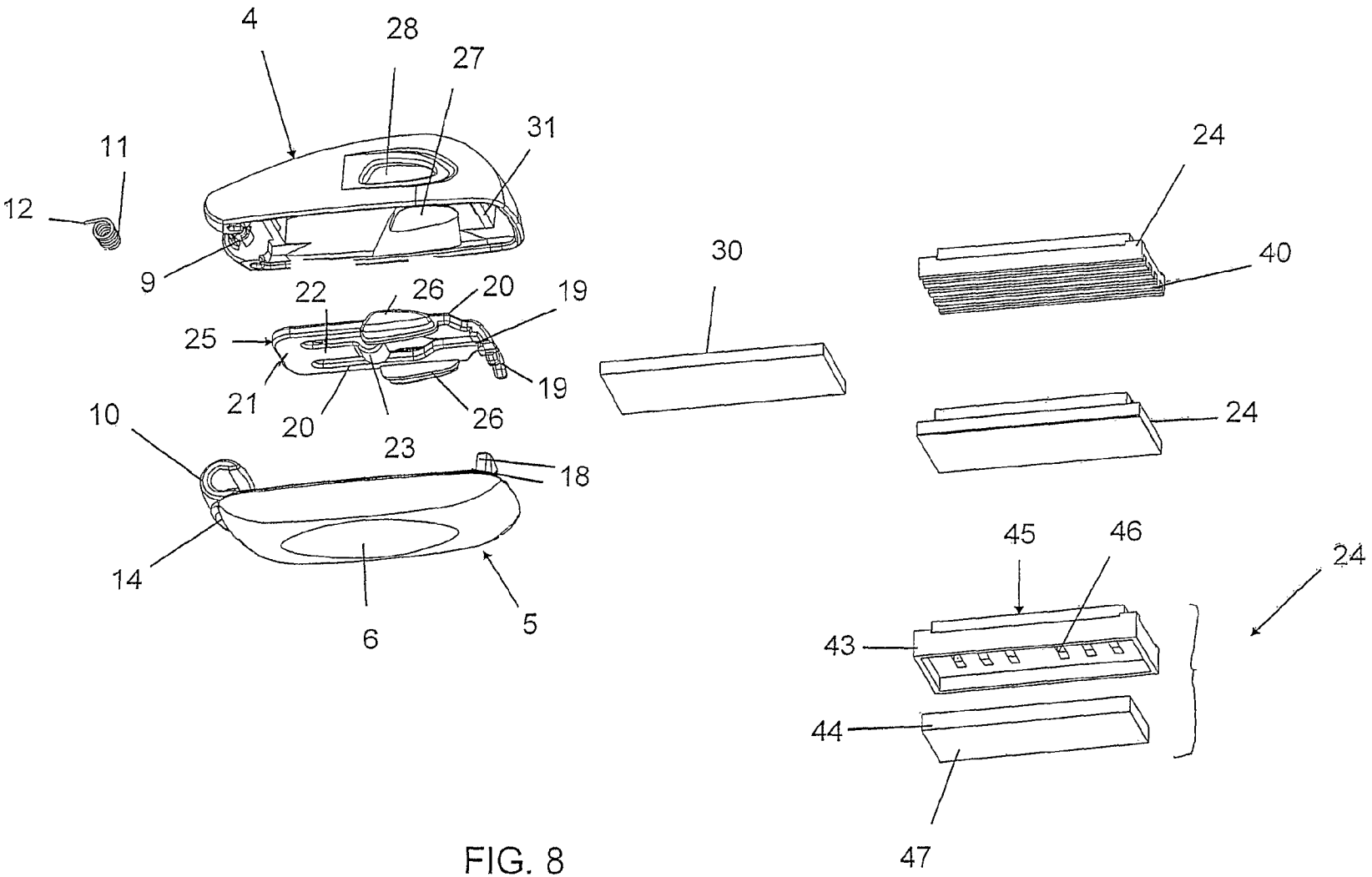
Figure 9:
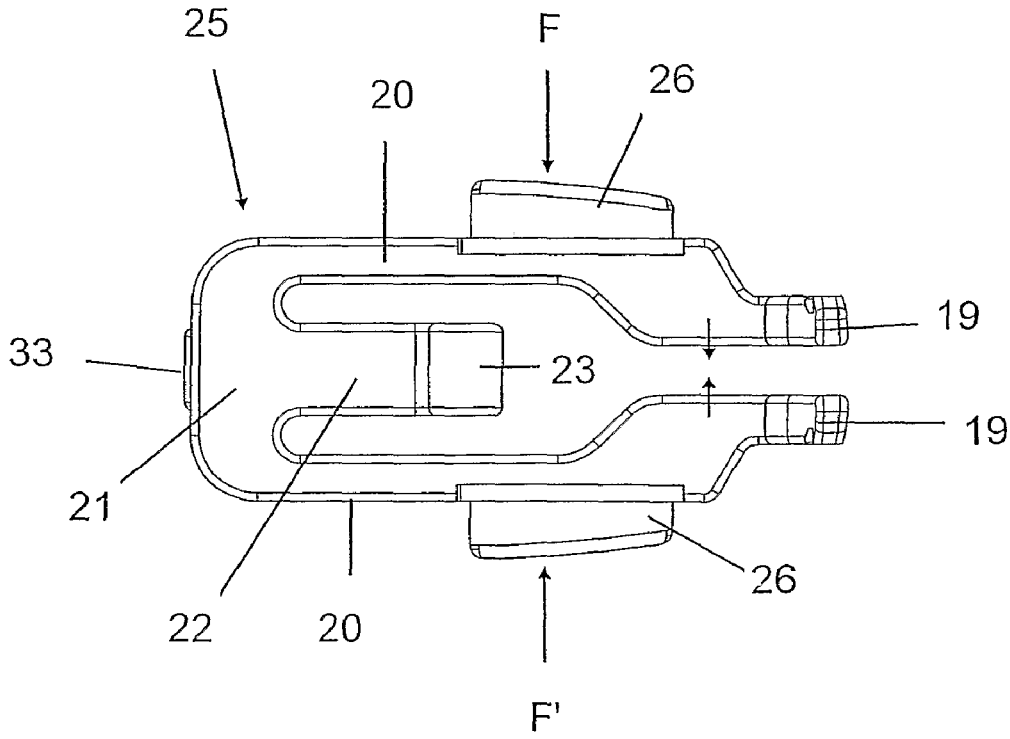
Figure 10:
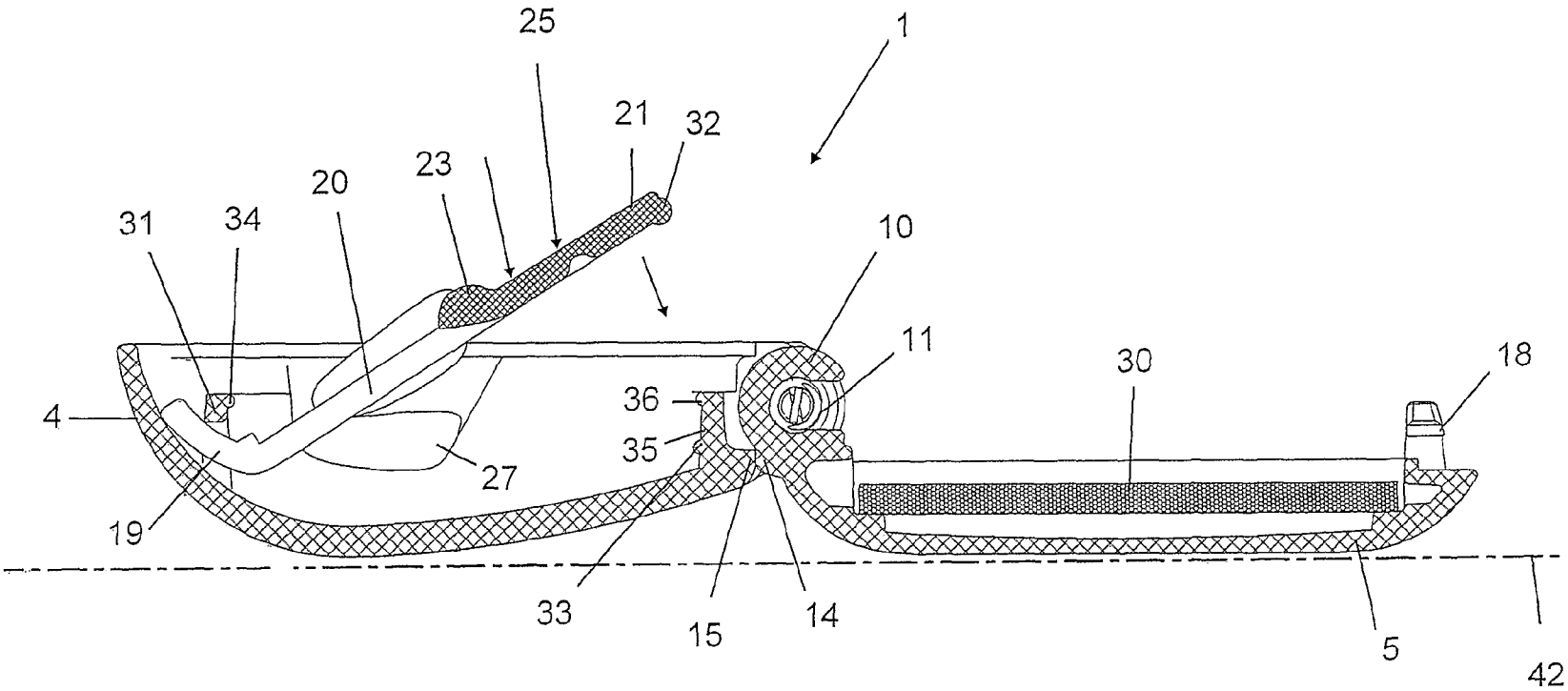
Figure 11:
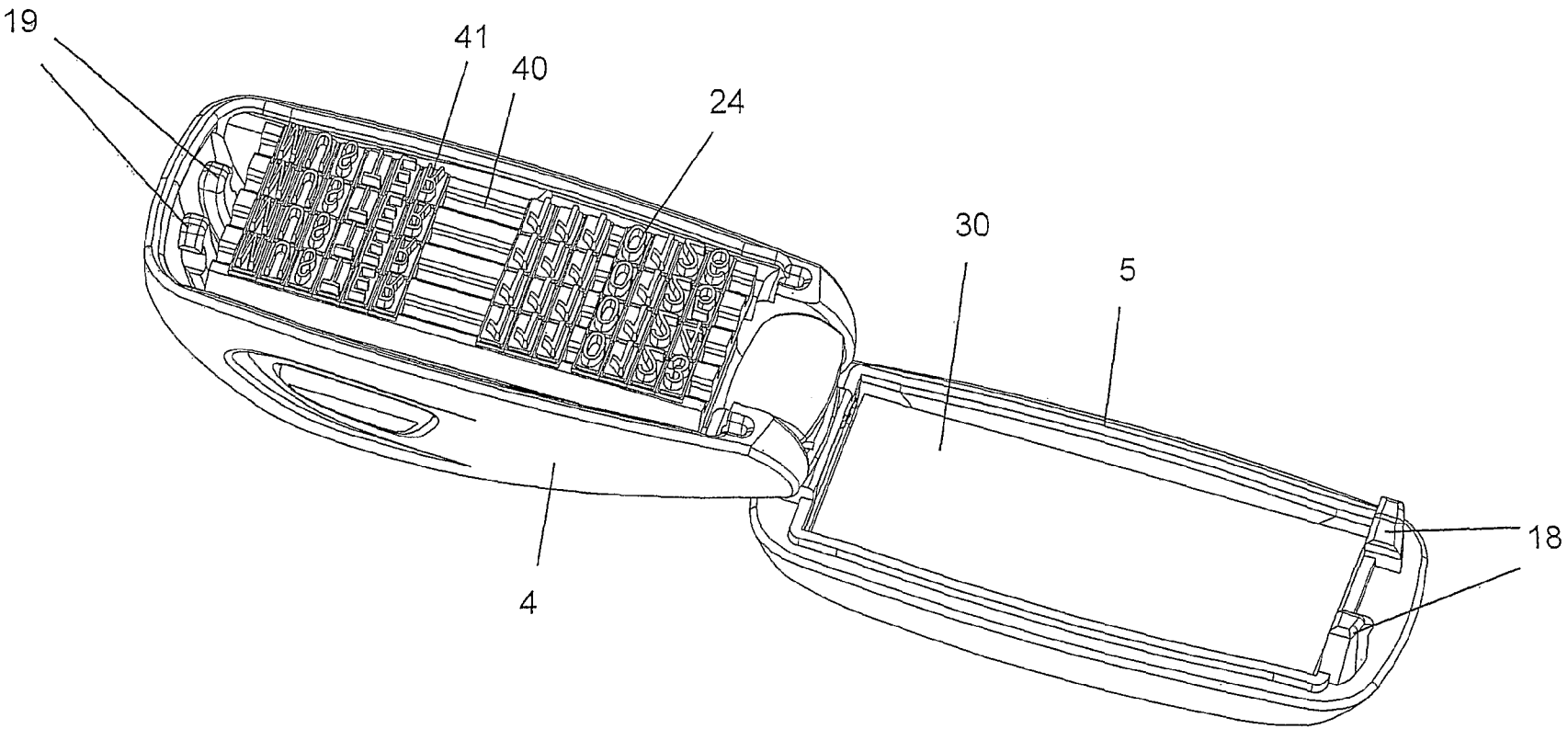
Figure 12:
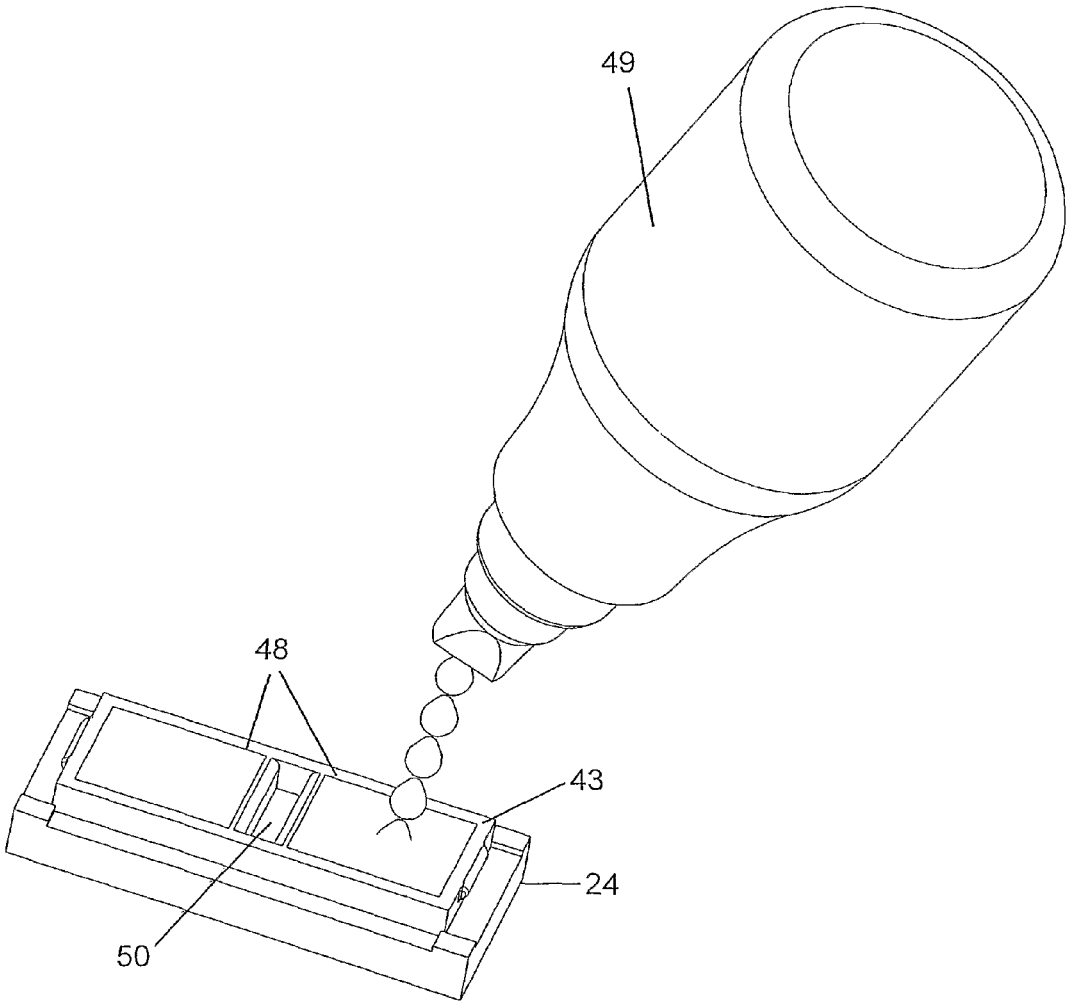
Figure 13:
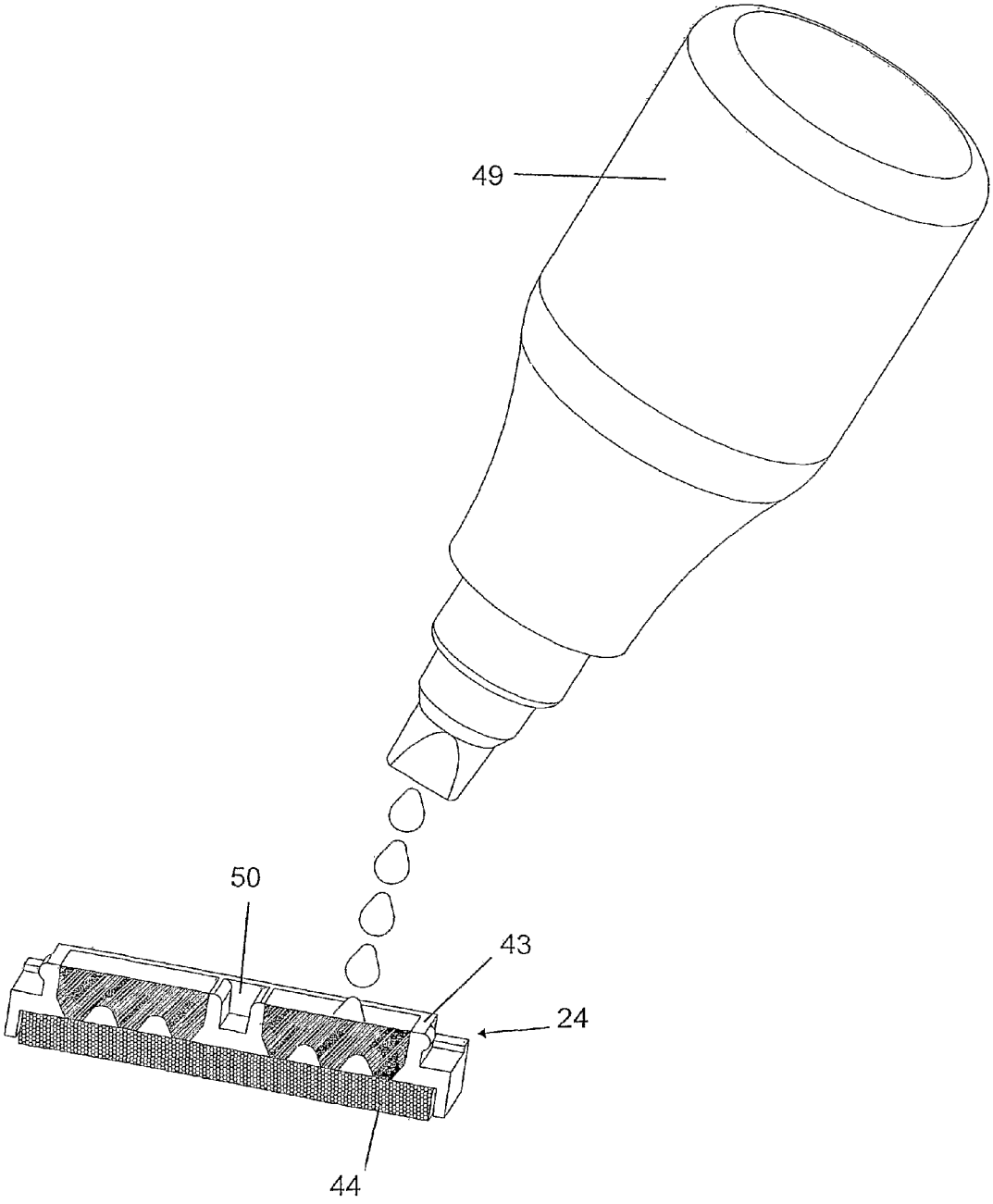
Figure 14:
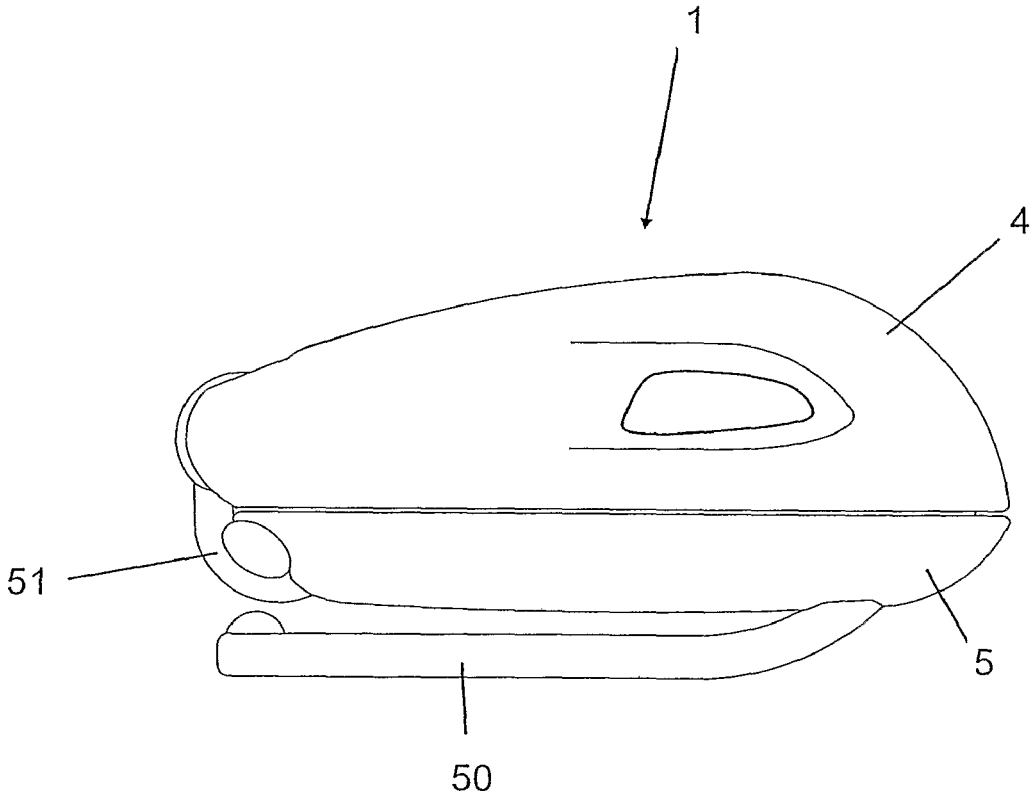
Figure 15:
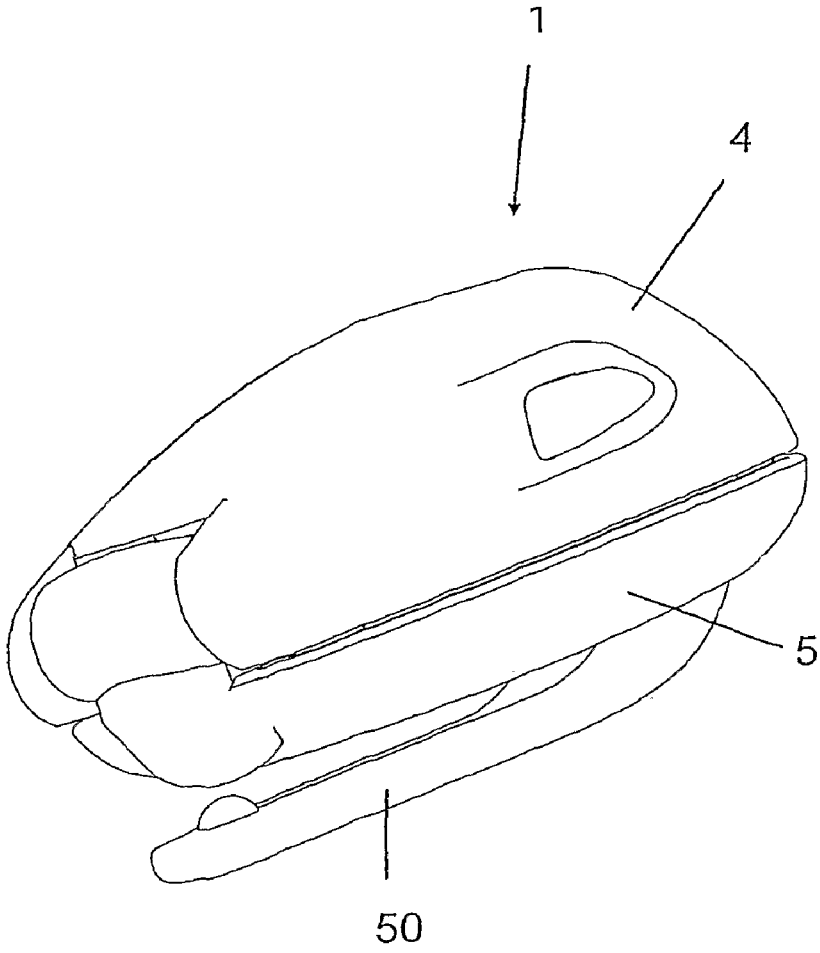
Figure 16:
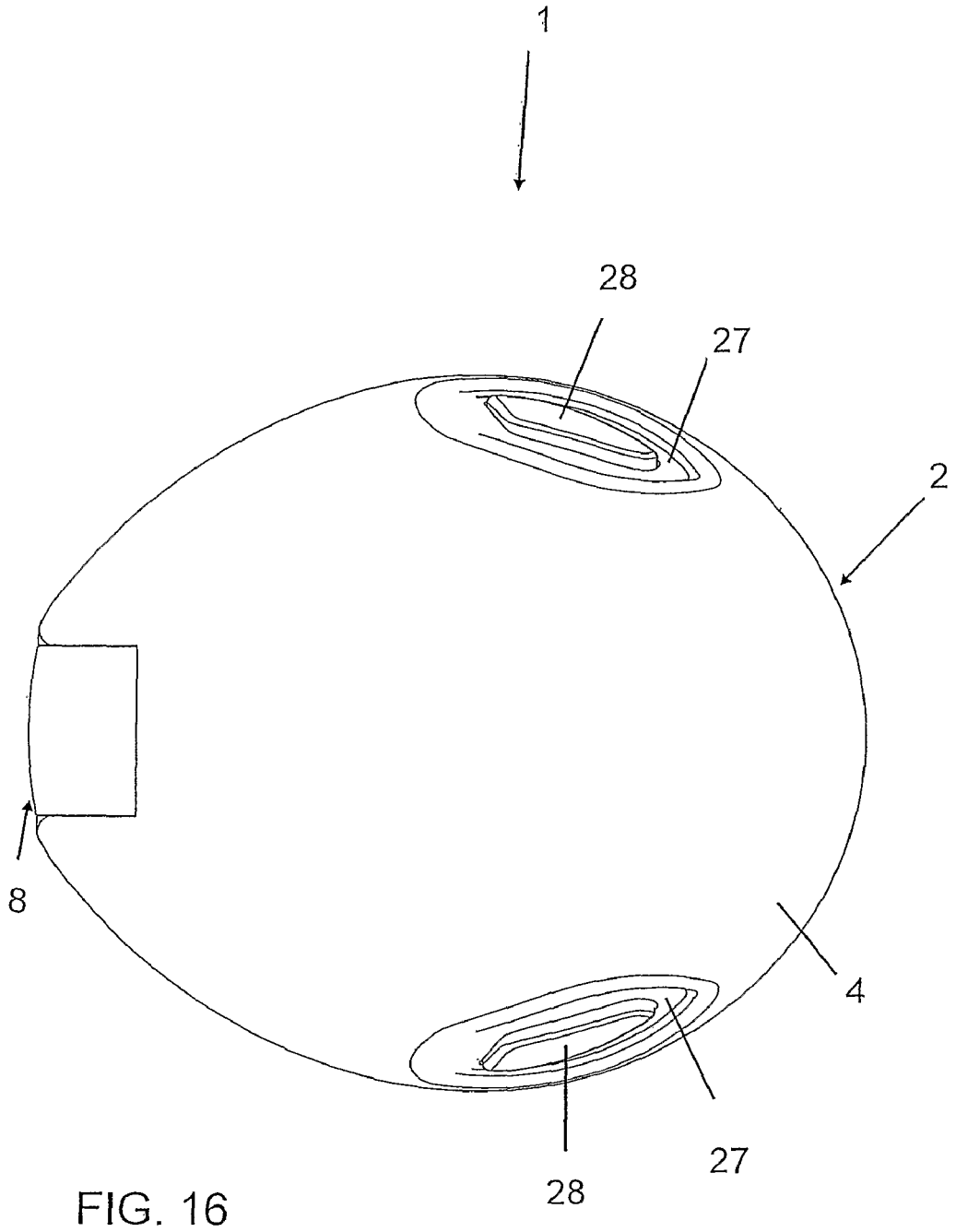
Figure 17:
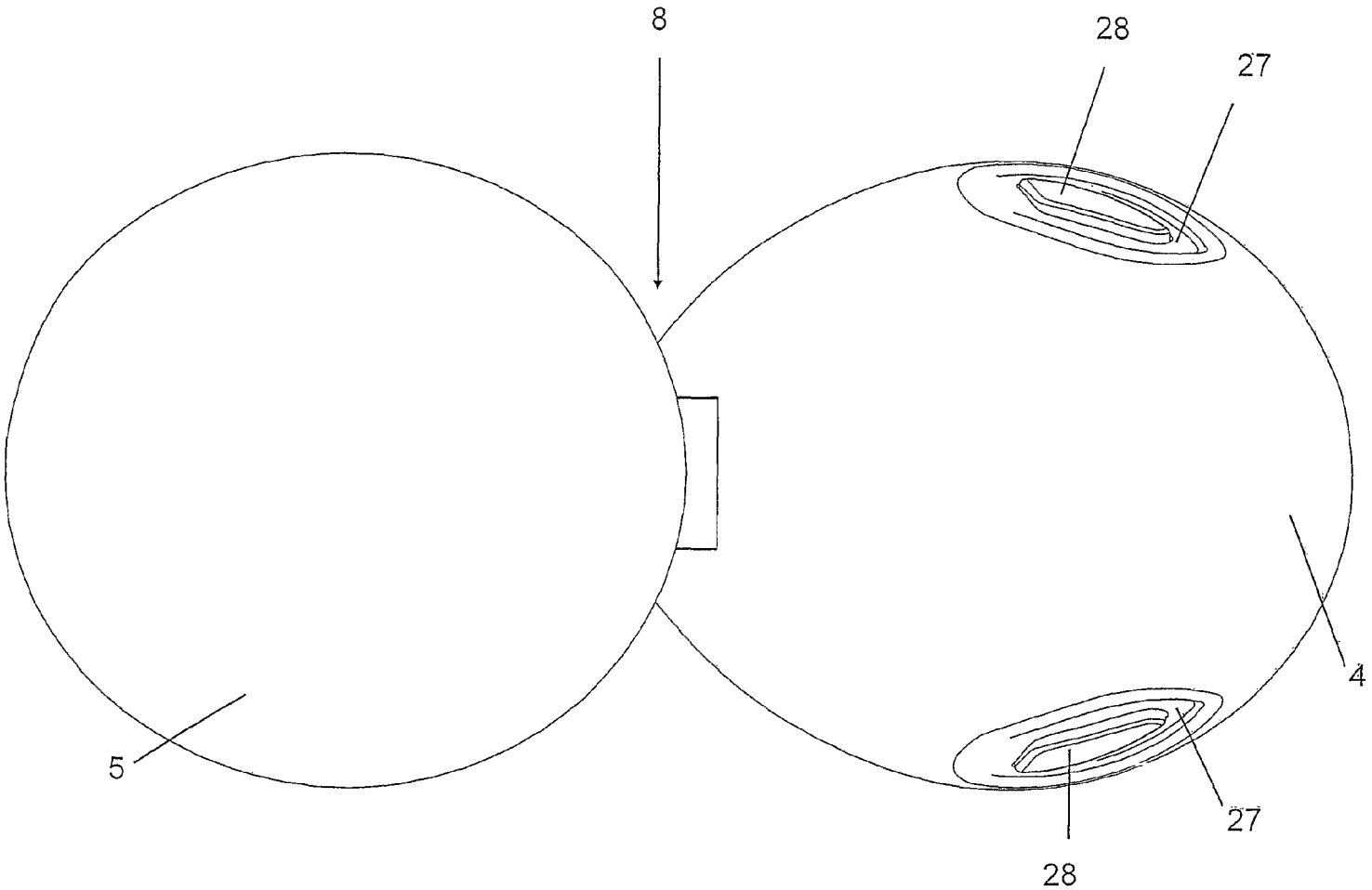
Figure 18:
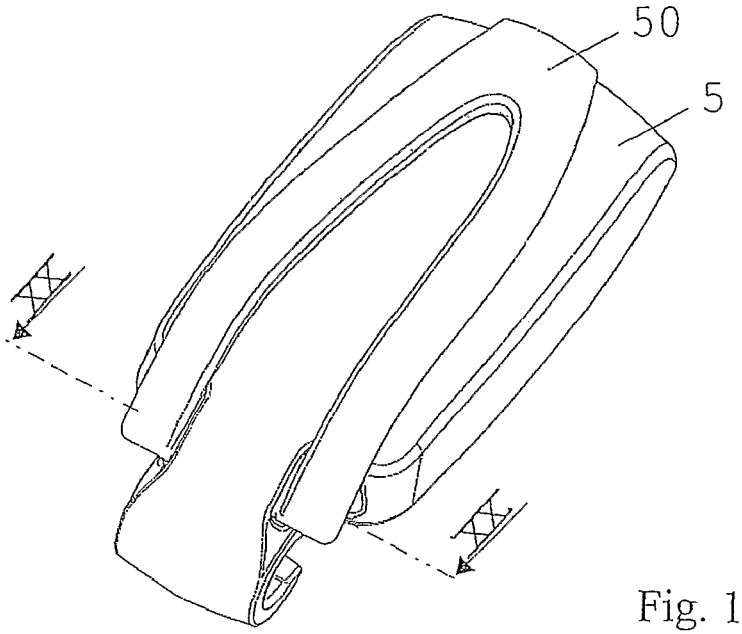
Figure 19:
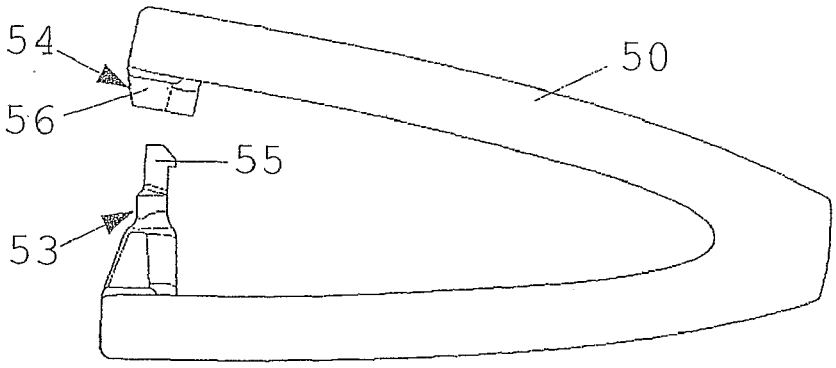
Figure 20:
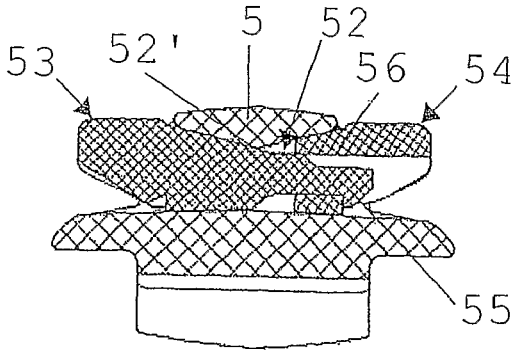
Figure 21:
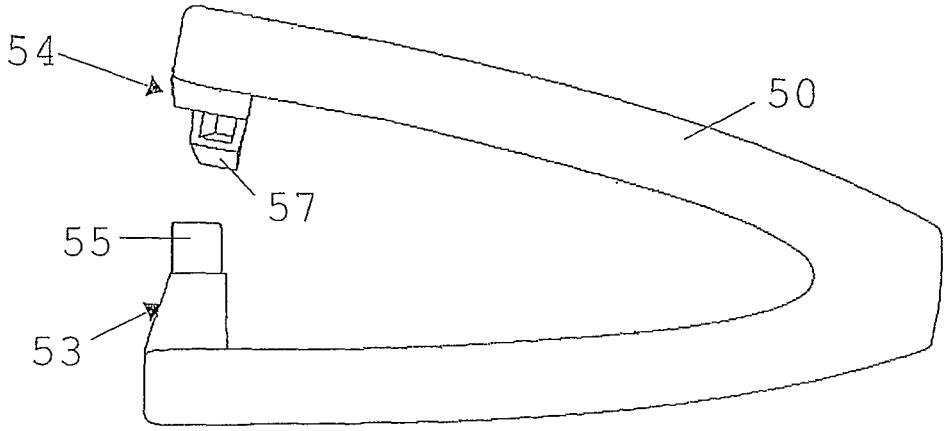
Figure 22:
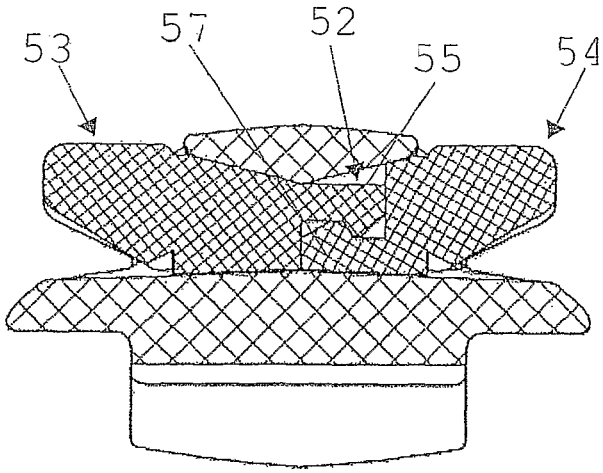
Figure 23:
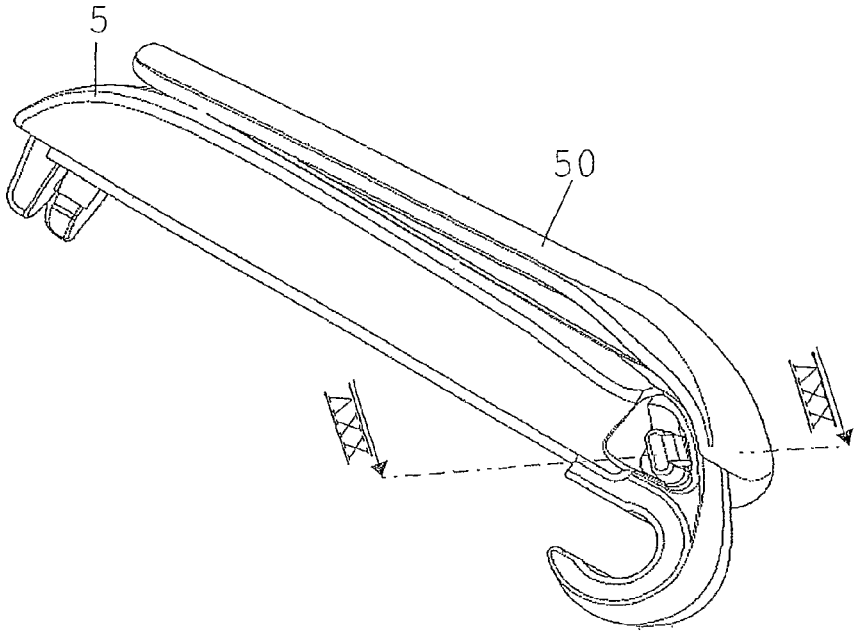
Figure 24:
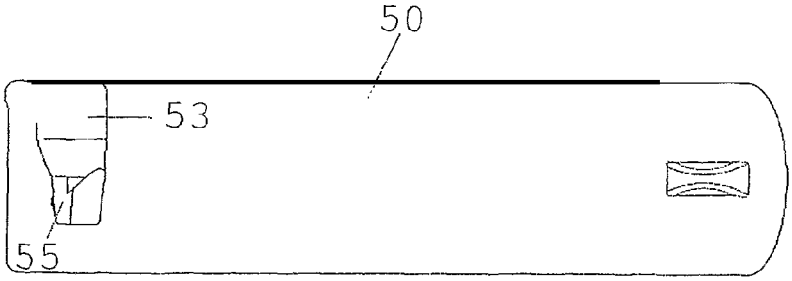
Figure 25:
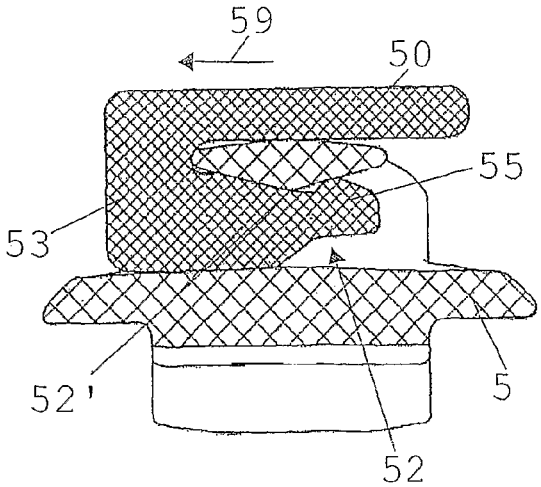

FIG. 7, in a similar illustration, yet on a reduced scale as compared to FIG. 6, shows the opened pocket stamp while further illustrating how the snapped-in stamp plate can be removed by the aid of a tool such as a screwdriver;

FIG. 8, in an exploded, axonometric view, illustrates the components of the pocket stamp according to FIGS. 1 to 7, wherein different types of stamp plates and an ink pad are additionally illustrated for elucidation;

FIG. 9 is a top view on the insert body used with the present pocket stamp and comprising two locking arms and a spring arm;

FIG. 10 shows a longitudinal section through a pocket stamp according to FIGS. 1 to 9 in the open position, with the stamp plate being removed and the insertion of the insert body being illustrated;

FIG. 11, in an elevational illustration similar to that of FIG. 6, shows a pocket stamp according to the invention, yet with a modified stamp plate, with separately insertable stamp types;

FIGS. 12 and 13 schematically illustrate the filling of a pre-inked-type stamp plate with stamping ink in an elevational view (FIG. 12) and in a longitudinal section (FIG. 13);

FIG. 14 is a side view of another embodiment of a pocket stamp according to the invention;

FIG. 15 is an elevational view of yet another embodiment of the pocket stamp according to the invention;

FIGS. 16 and 17 are schematic top views on a further pocket stamp according to the invention in the closed position (FIG. 16) and in the open position (FIG. 17);

FIG. 18 is an elevational view of a housing part with a clip fastened via a reception opening;

FIG. 19 is a view of the clip according to FIG. 18 in a position not fastened to the housing part;

FIG. 20 is a sectional view along line XX-XX of FIG. 18;

FIG. 21 is a view of another clip with an alternative fastening means;

FIG. 22 is a sectional view similar to that of FIG. 20, of the fastening means shown in FIG. 21;

FIG. 23 is an elevational illustration of a housing part 4 with a snapped-on clip;

FIG. 24 is a view from below, of the clip according to FIG. 23 fastened to the housing part 4; and FIG. 25 is a sectional view along line XXV-XXV of FIG. 23.

Figure 1:
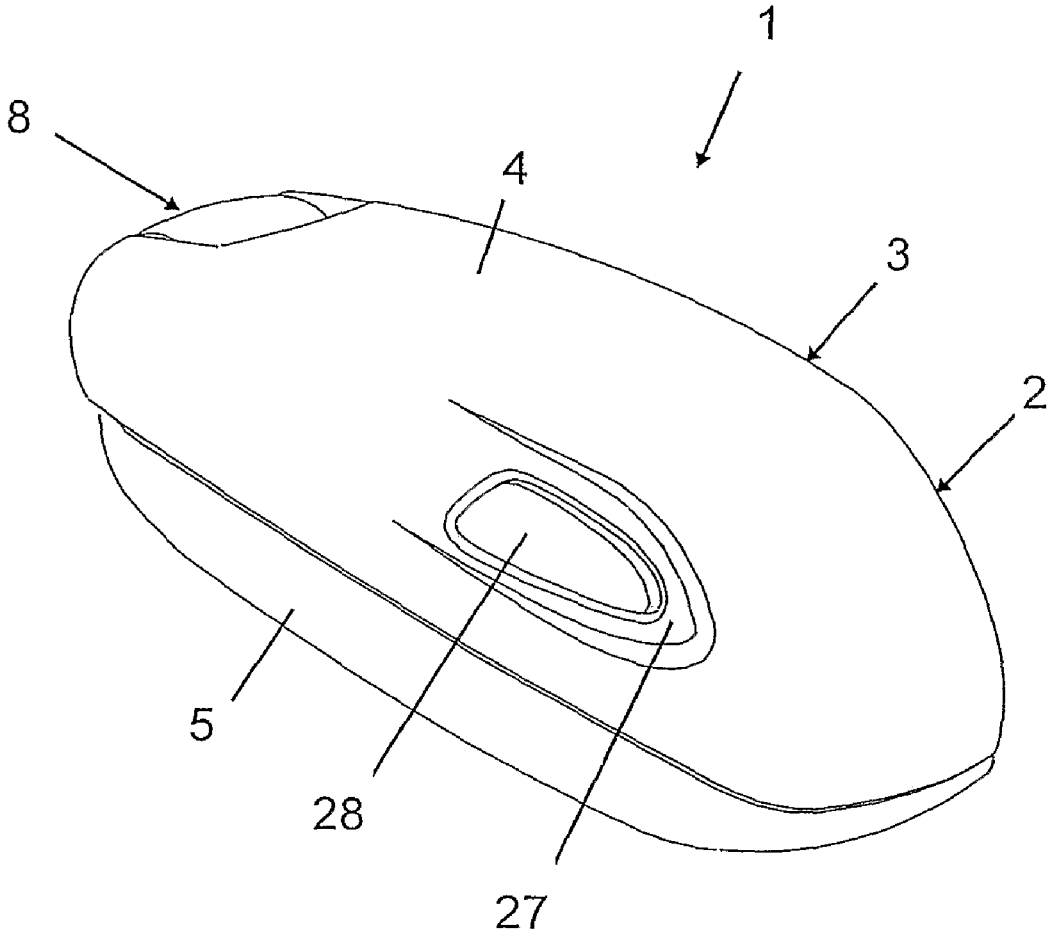
Figure 2:
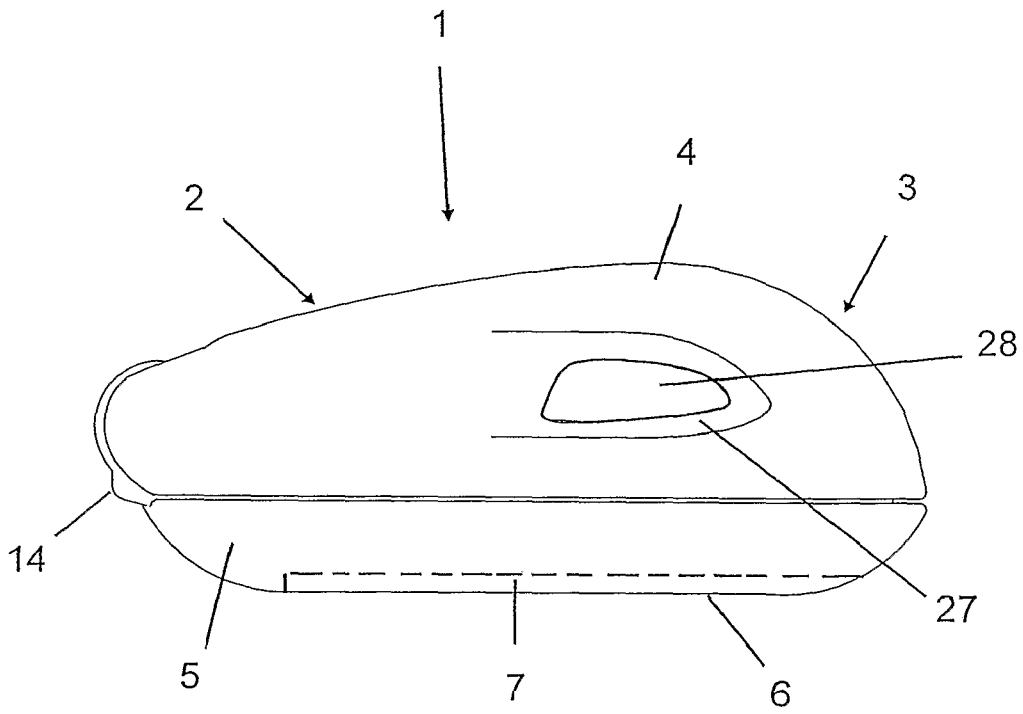
Figure 3:
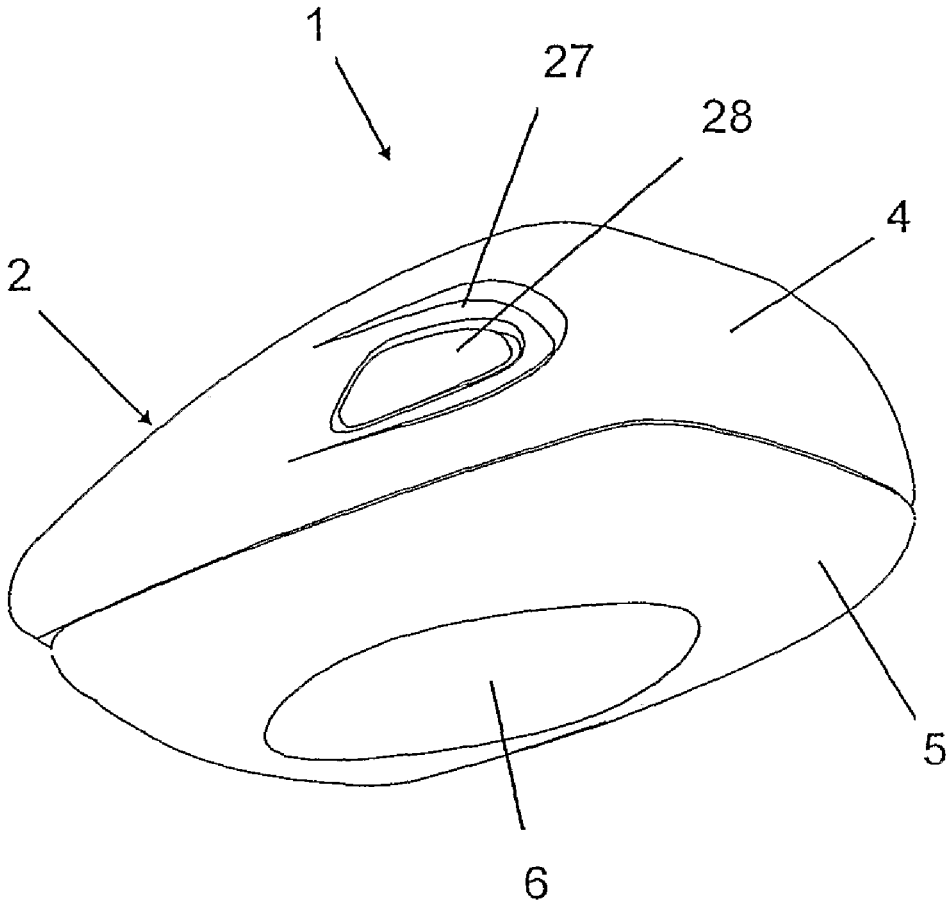

FIGS. 1 to 6 depict an embodiment of the pocket stamp 1 according to the invention in various views and positions, which pocket stamp comprises a housing 2 designed in the form of a case 3, as can best be seen from FIGS. 1 and 2. The housing 2 is comprised of two shell-shaped housing parts 4, 5 which are articulately connected to each other on one end, one housing part 4 of which, i.e. the upper housing part 4 in the illustrations according to FIGS. 1 to 5, at the same time serves as a handle portion or actuating portion for the pocket stamp 1. The other housing part, i.e. the lower housing part 5 in the illustrations according to FIGS. 1 to 5, has a flat bottom 6 to thereby provide a stand surface, and this flat or plane bottom region 6 may also comprise an observation window 7—which is only indicated in FIG. 2 by broken lines—, where a sample of the stamp impression can be provided on a suitably dimensioned sheet of paper in a manner known per se.

Figure 5:
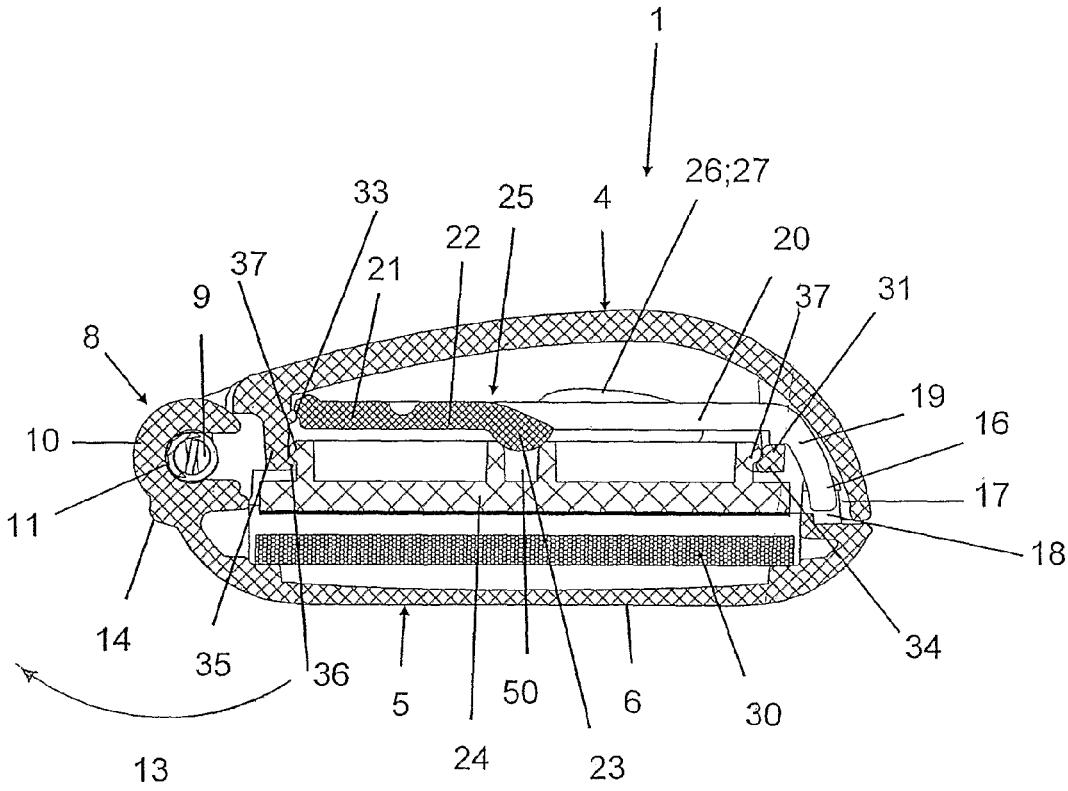
FIG. 5 is a longitudinal section through the pocket stamp according to FIGS. 1 to 4.

From FIG. 5, it is apparent that the housing parts 4, 5 on one of their sides, i.e. on the left-hand side in the illustration according to FIG. 5, are provided with a hinge joint 8 to articulately connect the two housing parts 4, 5 to each other. This hinge joint 8 is formed by correspondingly shaped pin 9 and shell parts 10 (cf. also FIG. 8), wherein a helical torsion spring 11 is, moreover, provided, which is arranged within the hinge joint 8 in a manner known per se to resiliently bias into the open position of the pocket stamp 1, which is apparent from FIG. 6, the shell part 10 of the hinge joint 8, and hence the lower housing part 5, by a spring leg 12 (FIG. 8), cf. also arrow 13 in FIG. 5. The shell part 10 of the joint 8, moreover, includes an integrally formed stop 14, by which the shell part 10, and hence the lower housing part 5, come into abutment on an end face 15 of the upper handle housing part 4 when the pocket stamp 11 is in the open position as illustrated in FIG. 10.

Figure 4:
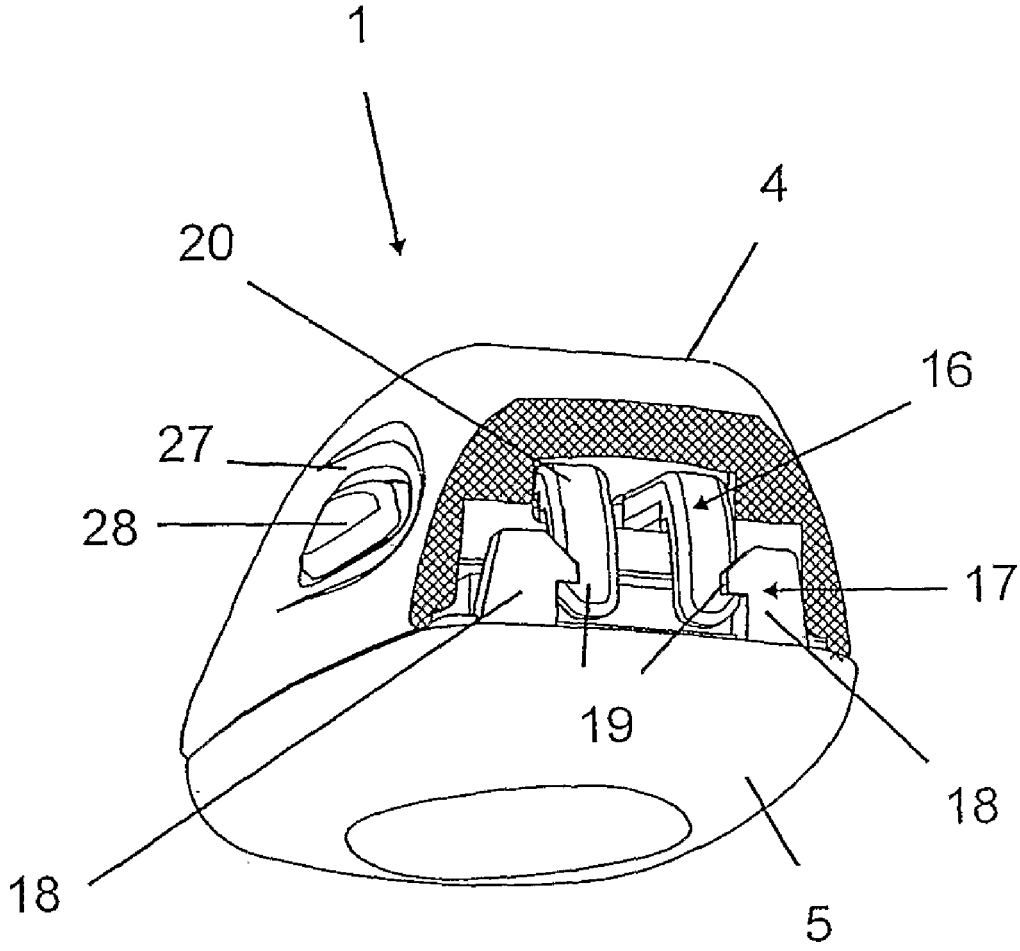
FIG. 4 is a partially sectioned oblique view from front and below to illustrate the function of the detent elements.

In the closed position illustrated in FIGS. 1 to 5, the two housing parts 4, 5 are mutually interlocked or interconnected by detent elements 16, 17, cf., in particular, FIGS. 4 and 5. The lower housing part 5, in particular, comprises two integrally formed hooks 18 as stationary detent elements 17, which, in the closed position, are each engaged from below by an angled end portion 19 of a ledger 20 as the movable detent element 16, as is particularly apparent from FIG. 4. The two substantially parallelly extending ledgers 20 depart from a common rear base portion 21, which is located near the joint 8 in the mounted state, as is particularly apparent from FIG. 8 and above all FIG. 9, extending in a spaced-apart relationship and at angles relative to the angled end portions 19. In the interspace between the two ledgers 20, a spring arm 22 is provided, which likewise departs from the base portion 21 and, on its free end, comprises an abutment cam 23 for a stamp plate 24 inserted, or to be inserted, in the housing part 4. An insert body 25 is thus obtained, whose locking arms 20 as resilient detent elements 16, in the closed position, cooperate by latching engagement with the fixed detent elements 17 formed by the hooks 18 and provided on the lower housing part.

In order to undo this latching engagement, the two ledgers 20 have to be displaced towards each other under elastic deformation as indicated by arrows F, F' in FIG. 9 in the region of integrally formed actuating projections 26, which, in the following, are briefly referred to as actuating regions 26. In order to accomplish this, elastically deformable wall portions 27 oppositely located in the upper housing part 4 are provided with press pieces 28, which can be pressed towards each other, i.e. inwardly, by the thumb and index finger, thus pressing the abutting actuating regions 26, and hence the ledgers 20, towards each other to thereby disengage the angled ends 19 of the ledgers 20 from the hooks 18. In doing so, the spring 11 urges the lower housing part 5 away from the upper housing part 4—which can still be held in the hand between the thumb and index finger—, pivoting the same, in the sense of arrow 13 in FIG. 5, into the open position according to FIG. 6 or 10, in which the stop 14 abuts on the abutment or end face 15, thus limiting the opening movement. In this open position, the stamp impression can then be made on a substrate—still without changing the grip on the upper housing part 4, cf. FIG. 6. In doing so, the actuating regions 26 will always abut on the deformable wall regions 27 on the inner side of the housing, as is basically also apparent from the exploded view according to FIG. 8.

Although separate movable detent elements 16 have been described above, it is, of course, also possible to provide such resiliently movable detent elements 16, in particular the ledgers 20, directly on a housing part, i.e. 4 (or 5), to integrally form with appropriate detent elements 16 elastically deformable wall portions which are comparable to the wall portions 27 provided on the inner side of the housing part; these detent elements 16 may cooperate with detent elements 10 provided on the other housing part 5 (or 4, respectively), which are again rigidly and integrally formed with this housing part in a manner comparable to the hooks 18 as described above. In this case, the separate insert body 25 may be omitted.

In the open position of the pocket stamp 1, the hooks 18 form a spacer relative to the substrate during stamping, as is apparent from FIG. 6 as well as FIG. 7 and FIG. 10, thus preventing an ink pad 30 accommodated in the housing part 5 carrying the hooks 18 from inadvertently dirtying the substrate with ink.

From FIG. 10, it is apparent how the insert body 25 is inserted into the housing part 4, i.e. the handle housing part 4, while its angled front end portions 19 are threaded in below a bridge 31 until its rear and 32, i.e. the slightly rounded and protruding right-hand end 32 in FIG. 10, snaps in below a detent bead 33 in the housing interior, cf. also FIG. 5. The bridge portion 31 carries an inwardly projecting stop 34 in the same way as the rear wall portion 35 of the housing part 4, on which the bead 33 is provided, comprises a projecting stop 36 opposite the stop 34. These stops 34, 36 limit the mobility of the stamp plate 24 in the housing part 4 in the direction out of the housing part 4, whereby the spring arm 22 presses the stamp plate 24 downward by its abutment cam 23, as is illustrated in FIG. 5, so that hook projections 37 provided on the rear side of the stamp plate 24 will come into abutment on the stops 34, 36, which form snap-in hooks. When inserting the stamp plate 24 into the housing part 4, the hook projections 37 will snap in behind the snap-in hooks or stops 34, 36, as is apparent from FIG. 5. The stamp plate 24 can be easily disengaged from this snap-in position, for instance by the aid of a screwdriver or similar tool 38, for instance if the stamp plate 24 is to be exchanged for a new one. The new stamp plate 24 will then merely have to be pressed into its snapping engagement position, as is apparent from FIG. 5.

The resilient mounting of the stamp plate 24 may also be such that the stamp plate 24 is pressed into the interior of the housing part 4 against the force of a spring during the making of a stamp impression until its impression surface is in alignment with the edge 4' of the opening of the housing part 4 (cf. FIG. 6) such that the housing part 4 will form a pressure limiting means by its edge 4' during stamping.

In addition to a conventional stamp plate 24, which is inked using an ink pad 30 inserted in the lower housing part 5 with the pocket stamp 1 in the closed position (cf. FIG. 5), FIG. 8 also depicts thereabove, in the right-hand half of the Figure, another stamp plate 24 which includes reception grooves 40 for individual stamp types 41 (cf. FIG. 11) as well as (therebelow) a pre-inked stamp plate 24. The insertion of the individual types 41 into the receptions 40 of the upper stamp plate 24, as shown in FIG. 9, with the pocket stamp 1 opened will be promoted by the latter lying planely in the open position as indicated in FIG. 10 by broken lines 42. The individual types can, thus, be inserted into the reception recess 40 of the stamp plate 24 according to FIG. 8 top right, or according to FIG. 11, in a manner known per se, for instance by the aid of tweezers. As for the rest, the pocket stamp according to FIG. 11 corresponds to that of the preceding Figures such that any further discussion can be omitted.

The stamp plate 24 depicted as a second alternative in FIG. 8 on the bottom right comprises a stamp plate body 44 of porous material, which is inserted in a cassette-like holding means 43, wherein the impression plate formed by this plate body 44 includes a storage body for ink supplied on the upper side (at 45) and entering the plate body 44 through openings 46, on the one hand, and a flash-type impression surface 47, on the other hand. Such pre-inked stamp plates 24 with ink storages and flash-type impression surfaces 47 are known per se and need no further discussion.

Only for the sake of completeness is the filling of such a pre-inked stamp plate 24 schematically illustrated in FIGS. 12 and 13, wherein stamp ink is, for instance, filled from a bottle container 49 into dosing-tank-like rear-side receptacles 48 of the cassette container 45. Between the two dosing receptacles 48, a transverse-groove-like recess 50 is provided, which is suitably also provided in the other stamp plates 24 to form kind of a pivot or swing bearing together with the abutment cam 23 for the stamp plate 24 in the operating position, cf. also FIG. 5.

The housing parts 4, 5 are designed in one piece in the described embodiment, yet may also be configured to comprise several pieces, e.g. be divided in the longitudinal direction, wherein, in particular, the upper housing part 4 might be divided in such a manner as to enable the mounting of the insert body 25 and the stamp plate 24 in one half of the housing part 4 from the side, whereupon the other housing part half would be slipped on. This would render superfluous the described snap-fastening means 32, 33 (including the threading-in of the insert body 25 with its front end 19 to below the bridge portion 31) as well as the stamp plate 24 in the region 34, 36/37, yet would require the manufacture of a separate part (a second half of the housing part 4). For this reason, the described one-piece configuration of the housing parts 4, 5 is preferred.

FIG. 14 depicts a slightly modified pocket stamp 1, which basically resembles the hitherto described pocket stamp 1, yet carries a clip 50 on its lower side, i.e. on the lower side of the bottom housing part 5, to clip the pocket stamp 1 onto a jacket pocket or the like. According to the illustration of FIG. 14, a lug 51 may furthermore be provided additionally, optionally, or instead, for instance again on the bottom housing part 5, in order enable the pocket stamp 1 to be attached to a carrying part (not illustrated) by the aid of a strap or chain. The pocket stamp 1 in FIG. 15 is only equipped with the clip 50, but not with such a lug.

From FIGS. 16 and 17, it is finally apparent that the present pocket stamp 1 may be designed not only with an elongate mouse-shaped housing 2, but also with a more round or oval housing 2, seen in top view, for instance if a round or oval stamp plate is desired rather than a rectangular stamp plate 24. Also in this case, deformable wall portion 27 with press pieces 28 may again be provided in order to disengage from the latching engagement the detent elements, which are not visible in detail and may be designed in a manner similarly as previously described.

In the embodiment according to FIGS. 16 and 17 as well as in the previously described embodiment according to FIGS. 1 to 15, the deformable wall portions 27 and press pieces 28 are suitably provided within the contour of the housing part 4 so as not to protrude, in order to prevent any unintended disengagement of the latching engagement, and hence dirtying of pockets etc., by the inadvertent opening of the pocket stamp 1.

FIGS. 18 to 25 depict different exemplary embodiments of clips 50 which can be modularly fastened to the housing part 5.

According to FIGS. 18 to 20, a clip 50 is provided, which has a substantially pin-shaped fastening web 53 received in a reception opening 52 of the housing part 5. The configuration of the reception opening 52 substantially corresponds to that of the lug 51 illustrated in FIG. 14 such that a strap or chain may also be threaded through the same as a carrying part, if no clip 50 is attached.

The clip 50 is substantially V-shaped, with the fastening web 53, on the one hand, and an opposite fastening web 54, on the other hand, being provided on its freely cantilevering ends, which are (at least partially) received in the reception opening 52 in the fastened position.

As is apparent from FIGS. 19 and 20, the substantially pin-shaped fastening web 53 carries a catch nose 55 on its free end. Said catch nose 55, in the closed position, engages an edge of an annular seat 56 of the web 54 from behind, as can be seen in FIG. 20. Due to the shape of the reception opening 52, which tapers from both ends towards a snap-on edge 52', the pin-shaped web 53, which is designed as an elastic tongue, can be pivoted upwardly before snapping or engaging into the position represented in FIG. 20.

An alternative exemplary embodiment for the catch or snap connection between the two fastening webs 53 and 54 is illustrated in FIGS. 21 and 22. Again, one 53 of the fasting webs comprises a front catch nose 55 which can be latched with a further catch nose 57 of the other, oppositely located fastening web 54 (cf. FIG. 22). Again, the clip 50 is thereby reliably retained in the reception opening 52, with the latch or snap connection between the catch noses 55, 57 being disengageable, and the clip 50 thus being readily removable from the reception opening 52, by an increased force application due to the elasticity of the material of the clip 50.

Still another exemplary embodiment of the clip 50 is illustrated in FIGS. 23 to 25, in which the clip 50 comprises a substantially rectangular all-over body which is provided with a bow-shaped fastening web 53 on whose freely cantilevering end a catch nose 55 is again provided. As is particularly apparent from FIGS. 23 and 25, this catch nose 55 of the fastening web 53 snaps in behind a protruding snap-on edge 52' of the reception opening in such a manner as to reliably retain the clip 50 in the position connected with the housing part 5. At an increased force application in the sense of arrow 59, the elastic fastening web 53 will be pivoted along with the catch nose 55 so as to release the snap connection and enable the clip 50 to be removed from the housing part 5.

The invention claimed is:

1. A pocket stamp (1) including a housing (2) which is configured in the shape of a case (3) having two articulately connected shell-shaped housing parts (4, 5) which can be brought from a closed position, in which they are releasably connected to each other by means of detent elements provided at the housing parts (4, 5), into an open position, in which a stamp plate (24) accommodated in one of the housing parts (4) and protruding over the edge thereof is present in its operation or impression position, in which the other housing part (5) is offset toward the rear in relation to the stamp plate (24), wherein in the closed position of the housing parts (4, 5), the detent elements are arranged within the housing parts (4, 5), wherein at least one detent element (17) in the shape of a hook (18) is immovably arranged in its housing parts (5) and a detent element (16) in the shape of a resiliently movable ledger (20) is arranged in the other housing part (4), and wherein one of the housing parts comprises an actuating portion which cooperates with an actuation region of one of the detent elements.

2. A pocket stamp according to claim 1, wherein the housing part (4) in which the resiliently movable detent element (16) is arranged comprises the actuating portion, said actuating portion comprising a press piece (28), which cooperates with the actuation region of the detent element (16).

3. A pocket stamp according to claim 2, wherein the press piece (28) is formed by an elastically deformable wall portion (27) of the housing part (4).

4. A pocket stamp according to claim 3, wherein the elastically deformable wall portion (27) is provided within the housing contour.

5. A pocket stamp according to claim 1, wherein two hooks (18) and two ledgers (20) are provided.

6. A pocket stamp according to claim 5, wherein the hooks (18) and the ledgers (20) are provided symmetrically in relation to a housing center plane extending perpendicularly to a hinge axis.

7. A pocket stamp according to claim 1, wherein the resiliently movable detent element (16) is formed by an insert body (25) detachably inserted in the housing part (4).

8. A pocket stamp according to claim 7, wherein the stamp plate (24) is resiliently mounted in its housing part (4).

9. A pocket stamp according to claim 8, wherein the insert body (25) comprises a central spring arm (22) which, with the stamp plate (24) inserted in the housing part (4), presses the same against edge-side stops (34, 36) provided in the housing part.

10. A pocket stamp according to claim 9, wherein the edge-side stops (34, 36) are formed by hook projections which are firmly connected, or designed in one piece, with the housing part (4) and, in the operating position, are engaged from behind by snap-in hooks (30) provided on the stamp plate (24).

11. A pocket stamp according to claim 9, wherein the insert body (25) includes two lateral ledgers (20), which extend from a common base portion (21) provided adjacent a joint (8) on one side of the housing (2) to the other side of the housing (4).

12. A pocket stamp according to claim 11, wherein the spring arm (22) likewise extends away from the base portion (21) of the insert body (25), yet is shorter than the ledgers (20) and carries an abutment cam (23) for the stamp plate (24).

13. A pocket stamp according to claim 1, wherein, in the other (5) of the housing parts, an ink pad (30) is arranged, on which the stamp plate (24) abuts in the closed position for inking.

14. A pocket stamp according to claim 1, wherein the stamp plate (24) comprises reception depressions (40) for insertable stamp types (41).

15. A pocket stamp according to claim 1, wherein the stamp plate (24) is a pre-inked stamp plate with an ink storage area (44) and a partially porous impression surface (47).

16. A pocket stamp according to claim 1, wherein one of the housing parts (5) comprises a lug (51) for attaching a strap or chain.

17. A pocket stamp according to claim 1, wherein one of the housing parts (5) carries a clip (50).

18. A pocket stamp according to claim 17, wherein the housing part (5) has a reception opening (52), in which at least one fastening web (53, 54) of the clip (50) is received.

19. A pocket stamp according to claim 18, wherein the fastening web (53, 54) comprises a catch nose (55, 57).

20. A pocket stamp according to claim 18, wherein the reception opening (52) tapers from its opposite ends to a substantially central snap-on edge (52').

21. A pocket stamp according to claim 19, wherein the catch nose (55) of the fastening web (53), in the position received in the reception opening (52), engages from behind an edge of an annular reception recess (56) of an oppositely located fastening web (54).

22. A pocket stamp according to claim 19, wherein the catch nose (55) of the fastening web (53), in the position received in the reception opening (52), engages from behind a catch nose (57) of an oppositely located fastening web (54).

23. A pocket stamp according to claim 19, wherein the catch nose (55) of the fastening web (53), in the position received in the reception opening, engages from behind a snap-on edge (52') of the reception opening (52).

24. A pocket stamp according to claim 1, wherein one of the housing parts (4, 5) comprises an observation window (6) for an impression sample.

25. A pocket stamp according to claim 1, wherein at least one of the housing parts (4, 5) is formed in one piece of a synthetic material, in particular by injection.

* * * * *